United States Patent [19]

Balentine, Jr.

[11] 3,961,651

[45] June 8, 1976

[54] APPARATUS FOR HEAT TREATING FABRIC AT THE LOOM

[76] Inventor: George H. Balentine, Jr., State Park Road, Greenville, S.C.

[22] Filed: July 24, 1974

[21] Appl. No.: 491,402

[52] U.S. Cl. ..... 139/291 R; 139/291 C; 26/106; 34/41; 34/158

[51] Int. Cl.[2] ..... D03D 49/00; D06C 3/10; F26B 3/32; F26B 13/00

[58] Field of Search ..... 139/291 R, 291 C, 302, 139/303; 28/1 CS, 72 CS; 26/60; 34/158, 141, 41

[56] References Cited

UNITED STATES PATENTS

| | | | |
|---|---|---|---|
| 2,236,754 | 4/1941 | Gurwick | 34/41 X |
| 2,318,533 | 5/1943 | Selvig | 34/41 X |
| 2,578,633 | 12/1951 | Mauffre | 34/41 UX |
| 2,591,861 | 4/1952 | Pannaci | 26/60 |
| 2,674,809 | 4/1954 | Meienhofer | 34/41 X |
| 2,771,659 | 11/1956 | Ball | 139/291 R |
| 3,187,162 | 6/1965 | Hojo et al. | 34/41 X |
| 3,235,931 | 2/1966 | Bruckner | 26/60 |
| 3,461,920 | 8/1969 | Sakamoto | 139/302 |
| 3,515,623 | 6/1970 | Bates | 139/291 R |
| 3,696,476 | 10/1972 | Mildon | 139/291 R |

FOREIGN PATENTS OR APPLICATIONS

| | | | |
|---|---|---|---|
| 857,664 | 12/1970 | Canada | 139/291 R |
| 1,006,944 | 10/1965 | United Kingdom | 139/291 R |
| 964,934 | 7/1964 | United Kingdom | 139/291 R |
| 1,033,276 | 6/1966 | United Kingdom | 139/291 R |

*Primary Examiner*—James Kee Chi
*Attorney, Agent, or Firm*—Bailey & Dority

[57] ABSTRACT

Apparatus for heat treating thermoplastic fabric at the loom is illustrated including an elongated housing extending across the full width of the loom having a passageway therethrough dividing the housing into opposed chambers, one of which carries a heating element and the other, a reflector so that the fabric is heated from both sides, and a gripping means is disclosed for tensioning the fabric in open width as it passes the heater means with a suction device for removing gases and fumes generated by heating of the thermoplastic fabric to elevated temperatures.

2 Claims, 6 Drawing Figures

APPARATUS FOR HEAT TREATING FABRIC AT THE LOOM

BACKGROUND OF THE INVENTION

Various attempts have been made to heat treat thermoplastic fabric at the loom. One such attempt is exemplified by the device illustrated in U.S. Pat. No. 2,769,222 wherein fabric to which tension has been applied is heated after it passes the take up roll utilizing a heater and reflector both positioned on one side of the fabric. U.S. Pat. No. 3,515,174 illustrates a further attempt to solve the problem utilizing a heater positioned above a take up roll which has a roughened surface for maintaining the fabric in open width against transverse shrinkage. Such devices, however, have been inadequate in so far as applying heat uniformly across both sides of the fabric and applying insufficient means for resisting lateral shrinkage of the fabric and no effort is made to remove the fumes resulting from heating the fabric to elevated temperatures.

Accordingly, it is an important object of this invention to provide apparatus and method for heat treating fabric at the loom wherein the fabric is maintained in open width resisting any tendency to shrink laterally by restraining the edges of the fabric against transverse shrinkage.

Another important object of the invention is to provide means for uniformly heating thermoplastic fabric and heat treating same at the loom by uniformly heating the fabric across both faces thereof while moving in open width at the loom.

Another important object of the invention is to exhaust fumes generated by heating fabric to elevated temperatures making possible heat treatment of fabric at the loom.

SUMMARY OF THE INVENTION

It has been found that apparatus and method for heat treating fabric at the loom may be provided wherein means for gripping the fabric moving in open width are provided for maintaining the thermoplastic fabric against transverse shrinkage while it is moving in open width between heaters which include a heating element positioned on one side of the fabric opposite a reflector carried by the other side of the fabric for reflecting heat transmitted through the fabric while moving in open width while providing means exhausting the fumes generated by heating the fabric and making provision for trimming the edges of the fabric engaged by the gripping means so that a fabric is produced having uniformly treated fabric extending entirely thereacross.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
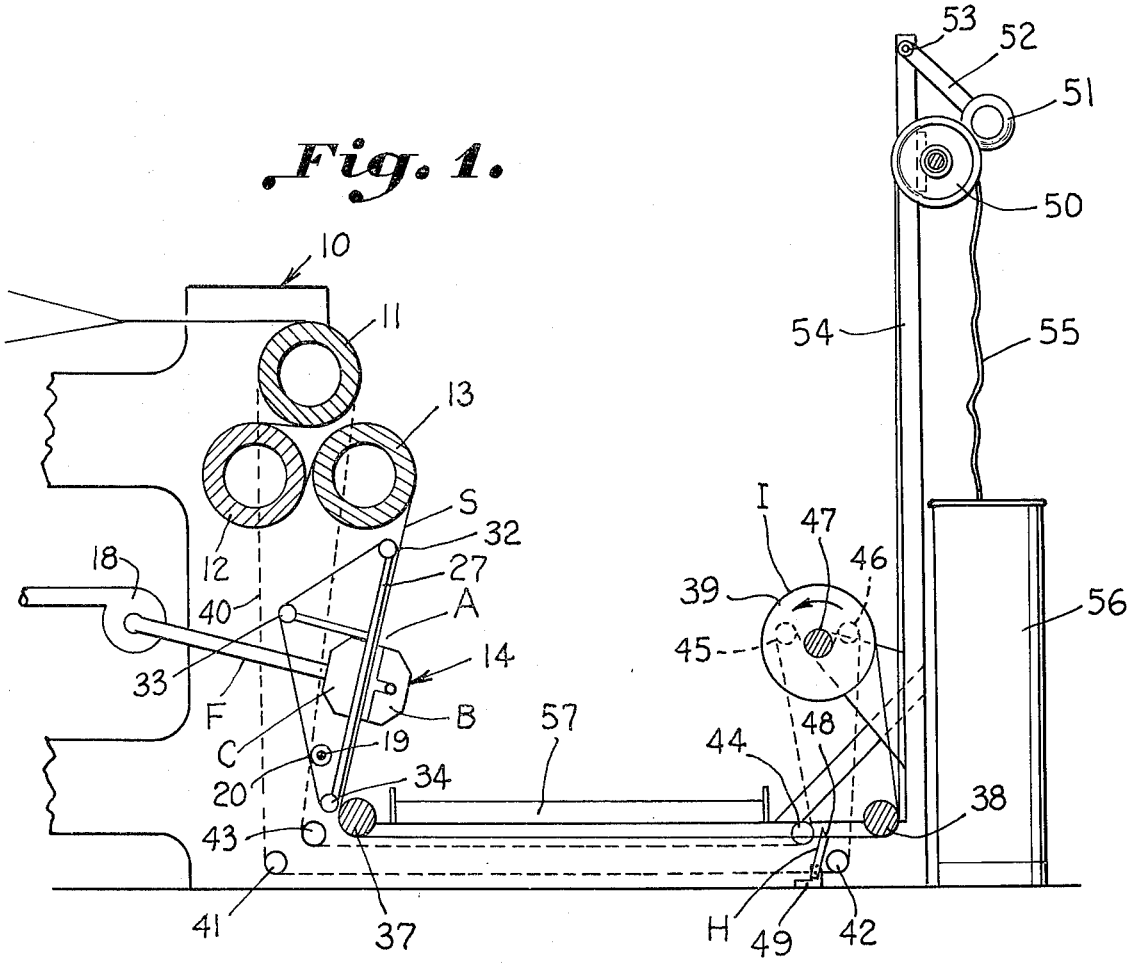
FIG. 1 is a transverse, sectional elevation illustrating a loom equipped with apparatus for heat treating fabric at the loom and carrying out the method in accordance with the present invention.
Figure 2:
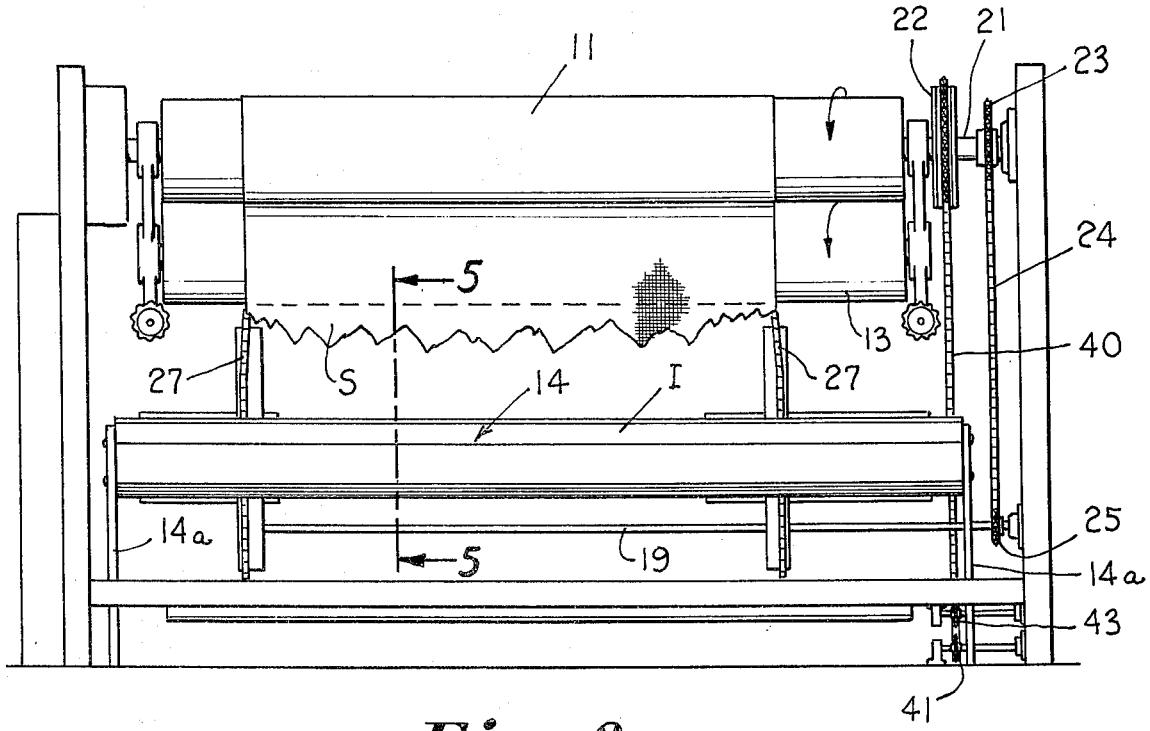
FIG. 2 is a front elevation with parts omitted of the apparatus illustrated in FIG. 1.

The drawings illustrate apparatus for heat treating fabric at the loom. An elongated housing extending across the full width of the fabric has a passageway A extending through the housing permitting the fabric to pass therethrough in open width. The housing is thus divided defining a pair of opposed chambers B and C therein. A heating element D is carried by the housing in one chamber. A heat reflector E is carried by the housing in one chamber. A heat reflector E is carried by the housing in the other chamber opposite said heating element so that the fabric passes between the heating element and the reflector.

An air hose F, equipped with means developing suction therein communicates with the interior of the housing whereby fumes developing from the action of heat on the fabric may be withdrawn from the housing. Means G is provided for restraining the edges of the fabric in open width against shrinkage during the application of heat thereto. Means H are also provided for trimming the edges from the fabric after heat treatment preparatory to winding the fabric into a roll. Means I is provided for taking the fabric up into a roll and for applying tension to the fabric from which the edges are being trimmed therefrom.

The loom which is broadly designated at 10 has a take up roll 11 over which the woven cloth passes to a bottom take up roll 12 and thence over a nip or pressure roll 13. The cloth in the form of woven fiberglass strands having a thermoplastic covering is used for form screen wire and is illustrated at S. The cloth then passes through the passageway A in the elongated housing broadly designated at 14. The housing 14 is generally octagonal in shape being is constructed of sheetmetal and carried by end supports 14a. The front chamber B carries a plurality of spaced support members 15, each of which has a central slot opening in a front face thereof as at 16 for carrying the heating element D. The opposed chamber C carried behind the fabric carries a heat reflecting element E therein secured as by screws 17.

At the rear of the chamber C, an air hose F is suitably attached and is provided with means for inducing suction therein in the form of the impeller fan 18.

The means G for restraining the edges of the fabric in open width against shrinkage during the application of heat thereto is driven from a shaft 19, which carries a pair of spaced sprockets 20 thereon. It will be observed that the take up roll is driven from the loom motor, which will be described in detail below through suitable gearing. The shaft 21 carries a clutch and sprocket drive arrangement 22 for driving the take up mechanism as will be described in greater detail below while the sprocket 23 drives a chain 24 which, in turn, drives the shaft 19 through a suitable sprocket 25.

The means G for restraining the fabric consists essentially of a pair of spaced assemblies, each of which includes chains 27 which carry flat members 28 which have a number of aligned projecting pins 29 for engaging the selvages of the cloth S. The chain 27 is carried in an outwardly inclined guide or cam 30 and is cammed out into the guide track way 31 for stretching the selvages of the cloth S as it passes through the slot A. The chain is carried on three spaced sprockets 32, 33 and 34 which are, in turn, carried by suitable bracket supports, 32*a*, 33*a* and 34*a*. The bracket 33*a* is provided with a longitudinal adjustable means 33*b* having adjusting bolts 35. The positioning of the chains 29 is adjusted by varying the position of the bolts 3 to vary the angle of the guide member 30.

Figure 3:
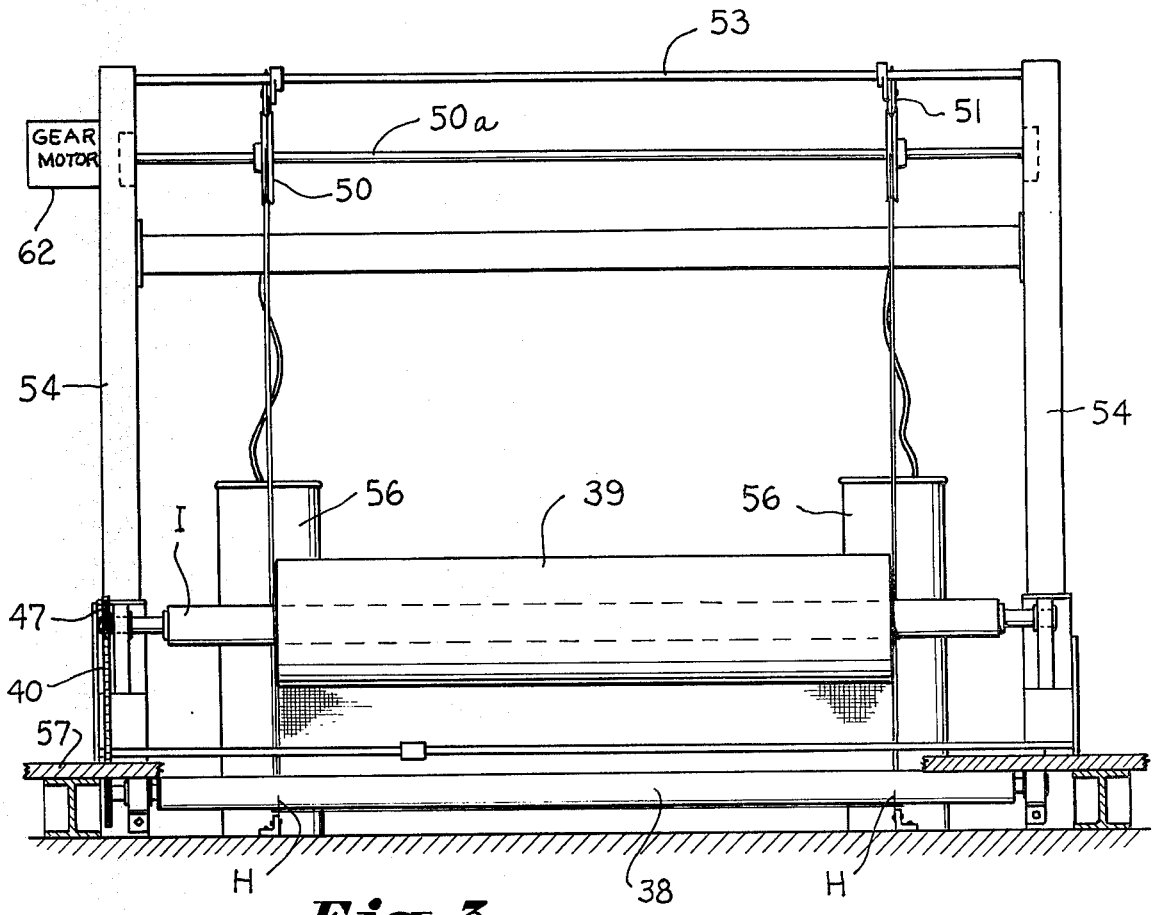
FIG. 3 is a rear elevation.

The cloth S thence passes beneath the roll 37 and beneath the roll 38 from whence it is wound by means I for taking up the fabric in a roll 39. The means I are driven by a suitable chain 40 which passes over the sprockets 41 and 42. The run of the chain 40 also passes over the sprockets 43 and 44 and beneath the sprockets 45 and 46 to drive the cloth roll in the direction of the arrow through a sprocket (not shown) carried by the roller 47 on which the cloth roll 39 is wound. The means H for trimming the fabric include a vertically disposed cutting element such as a razor blade 48 carried as by a bracket 49. The razor blades are spaced as illustrated in FIG. 3 on each side to trim the selvages from the fabric S. The selvages are pulled as by rolls 50 which are driven by a suitable gear motor 62 (FIGS. 3 and 4) which will be described further below. Pressure rolls 51 are carried by links 52 pivoted as on the bar 53 on a suitable, vertical supporting frame 54. The selvages which are designated 55 (FIG. 1) pass into a suitable receptacle in the form of a can 56 for collecting same on each side of the loom. The rolls 50 are carried by a suitable shaft 50*a* and are in the form of V-shaped sprockets 50 carried on the shaft 50*a*. If desired, a suitable platform structure 57 may be constructed over the cloth S as it passes to the take up mechanism from the loom.

Figure 4:
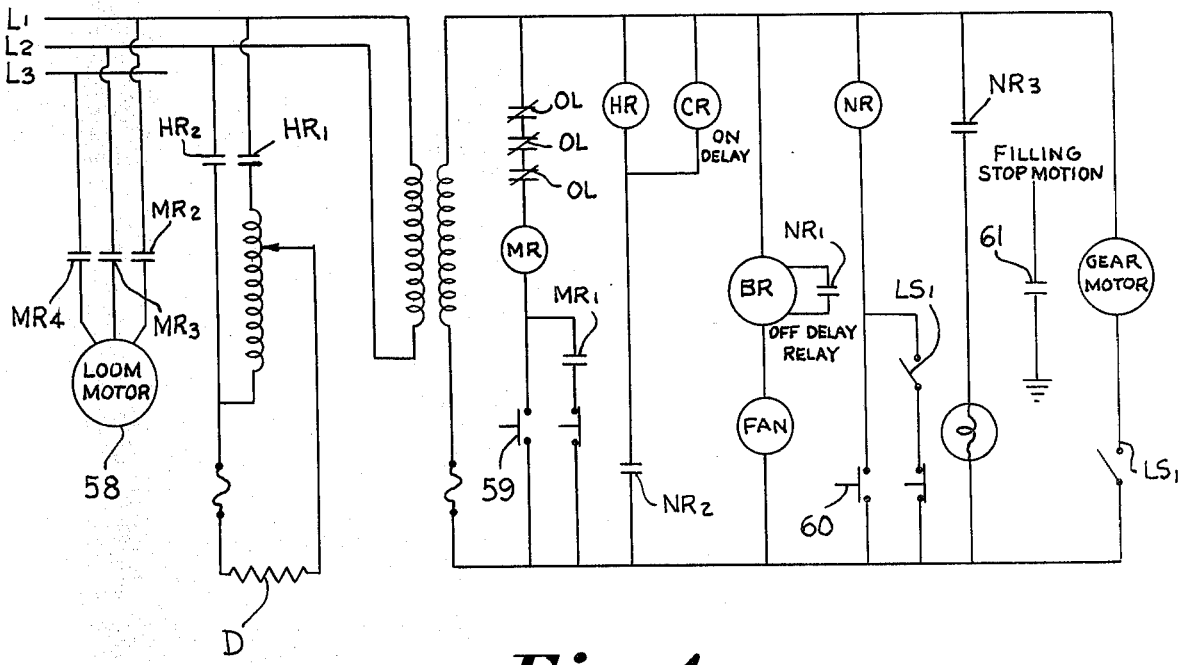
FIG. 4 is a schematic, electrical diagram illustrating the various electrical components.
Figures 5, 6:
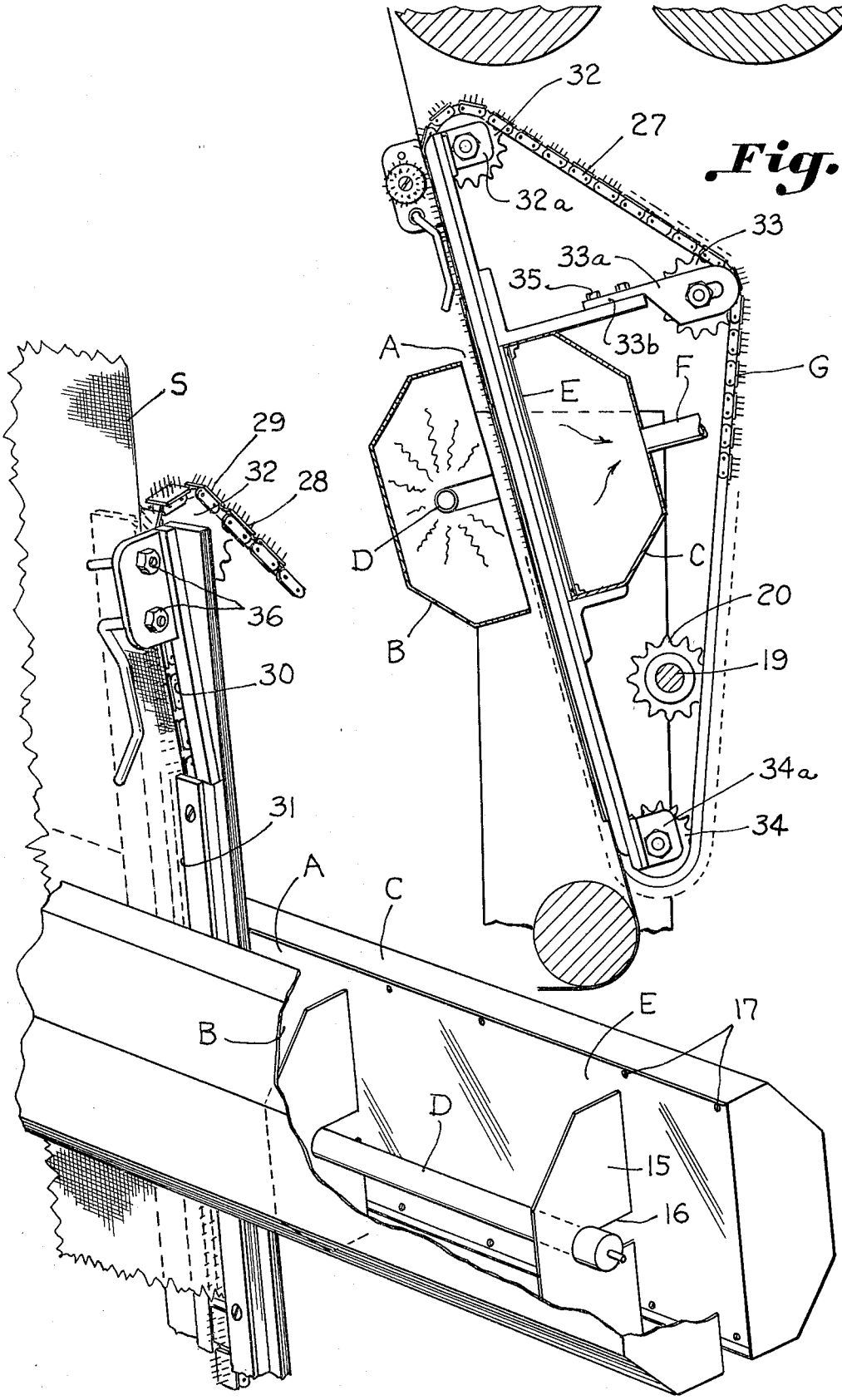
FIG. 5 is a transverse, sectional elevation taken on the line 5—5 in FIG. 2.
FIG. 6 is a perspective view looking toward the rear of the heating and selvage gripping mechanism looking from the left hand side of FIG. 1.

Referring now to FIG. 4, it will be observed that the loom motor 58 is carried across a three phase supply which includes lines L1, L2 and L3. The loom motor 58 is started by depressing the pushbutton 59 which, through the relay MR, closes relay contacts MR1, MR2, MR3 and MR4. By concurrently pressing the pushbutton 60 which operates the heater circuit, the relay NR closes relay contacts NR1, NR2 and NR3. Contact NR2 actuates the relay HR which has an on delay mechanism CR. The relay HR operates contacts HR1 and HR2 permitting the heater D to be actuated after a suitable time has passed to permit fabric which has already been heat treated to pass beyond the heater. The filling stop motion 61 opens should a defective filling occur stopping the loom motor 58. If the loom stops for any reason, a cam from the starting lever (not shown) opens the double pole single throw switch LS1. This causes the circuit to the gear motor 62 to open. Contact NR1 operates delay mechanism BR which controls the fan 18. Contact NR3 operates a signal lamp.

It should be noted that the fan 18 draws air into the housing 14 through the passageway A making possible removal of the fumes through the air hose F. Thus, the entire operation of heating, trimming and taking up the fabric occurs at the loom. Handling and duplication of operations are greatly reduced through simplified structure and method.

While a preferred embodiment of the invention has been described using specific terms, such description is for illustrative purposes only, and it is to be understood that changes and variations may be made without departing from the spirit or scope of the following claims.

What is claimed is:

1. An apparatus for heat treating fabric at the loom comprising:

an elongated housing extending across the full width of the fabric;

a passageway extending through said housing permitting the fabric to pass therethrough in open width and dividing said housing defining a pair of opposed chambers therein;

a heating element carried by said housing in one chamber;

a heat reflector carried by said housing in the other chamber opposite said heating element so that the fabric passes between the heating element and the reflector;

means for restraining the edges of the fabric in open width against shrinkage during the application of heat thereto;

an air hose communicating with the interior of said housing;

means developing suction on said air hose;

whereby fumes developing from the action of heat on the fabric may be withdrawn from said housing.

2. The structure set forth in claim 1 wherein said means for restraining the edges of the fabric include, a pair of spaced longitudinally disposed driven gripper chains having a vertical run, and camming means guiding said vertical run to stretch said fabric held between the chains.

* * * * *